US006024268A

United States Patent [19]

Horng-Lin

[11] Patent Number: 6,024,268

[45] Date of Patent: Feb. 15, 2000

[54] NAIL ENGAGING DEVICE FOR A POWER NAILER

[75] Inventor: Juinn Horng-Lin, Taichung, Taiwan

[73] Assignee: Basso Industry Corp., Taichung, Taiwan

[21] Appl. No.: 09/264,647

[22] Filed: Mar. 8, 1999

[51] Int. Cl.[7] ..... B25C 1/04

[52] U.S. Cl. ..... 227/120; 227/109; 227/119; 227/136

[58] Field of Search ..... 227/120, 123, 227/135, 136, 137, 119, 109

[56] References Cited

U.S. PATENT DOCUMENTS

| | | | |
|---|---|---|---|
| 5,240,161 | 8/1993 | Kaneko | 227/109 |
| 5,332,141 | 7/1994 | Mukoyama et al. | 227/136 |
| 5,738,266 | 4/1998 | Ogawa | 227/119 |
| 5,772,098 | 6/1998 | Crutcher | 227/119 |
| 5,799,856 | 9/1999 | Mukoyama | 227/136 |

*Primary Examiner*—Scott A. Smith
*Attorney, Agent, or Firm*—Charles E. Baxley, Esq.

[57] ABSTRACT

A nail engaging device includes a nail input chamber which is connected between the barrel and the nail box, and a plug is connected below the nail input chamber which has a plurality of holes. A cover is pivotally mounted to the barrel and has a recess defined in the inside thereof so that a front sub-pushing member and a rear sub-pushing member are pivotally engaged with the recess of the cover. A main pushing member is engaged with the holes of the nail input chamber so as to engage with the first nail. The rear sub-pushing member has a first stop extending from the top thereof and the front sub-pushing member has a second stop extending from the top thereof so that the rear sub-pushing member can be pivoted to adapt the different thickness of the two types of nails.

3 Claims, 6 Drawing Sheets

NAIL ENGAGING DEVICE FOR A POWER NAILER

FIELD OF THE INVENTION

The present invention relates to a nail engaging device for a power nailer, and more particularly, to a nail engaging device which is able to engage with nails connected by wires and nails connected by a plastic plate.

BACKGROUND OF THE INVENTION

Two types of nails 15, 16 as shown in FIGS. 2 and 2A are used in a conventional power nailer 100, as shown in FIG. 1. The nails 15 show in FIG. 2 is connected by two metal wires 150 and the nails 16 shown in FIG. 2A is connected by a plastic plate 17. The power nailer 100 includes a nail engaging device so as to engage the nails 15/16 and send the nails 15/16 into the barrel 101 of the power nailer 100 to be ejected by an impact member (not shown). The nail engaging device includes a pushing means which is composed of a main pushing member 11 and a sub-pushing member 10 which is connected to a cover 13, and a plug 12 movably received in the nailer 100. The nails 15 are inserted into a slot 14 defined in the connecting plate below the plug 12 and the cover 13 then covers the slot 14 so as to push the first nail 15 into the barrel 101 of the nailer 100. The second nail 15 is engaged with the main pushing member 11 and the sub-pushing member 10 is located below the second nail 15. When pulling the trigger 102 of the nailer 100, the first nail 15 is injected and the pressurized air pushes the plug 12 downwardly to move over the second nail 15 which is stopped by the sub-pushing member 10 and engage with the third nail 15. When the plug 12 returns by a spring (not shown) connected thereto, the third nail 15 is pushed above the sub-pushing member 10 and the second nail 15 is pushed into the barrel 101 ready to be injected. Because the thickness of the plastic plate 17 and the metal wires 150 are different so that the manufacturers have to made two types of nail engaging devices, that is to say, the users have to prepare two different power nailers if they try to use both of the two types of the nails 15, 16.

The present invention intends to provide a nail engaging device for a power nailer wherein the nail engaging device of the present invention includes a front sub-pushing member and a rear sub-pushing member so as to adjustably engage with the two types of nails. According to the nail engaging device of the present invention, the users can use the two types of nails as needed in the same power nailer.

SUMMARY OF THE INVENTION

In accordance with one aspect of the present invention, there is provided a nail engaging device for a power nailer and comprising a nail input chamber connected between the barrel and the nail box of the power nailer, and the nail input chamber having a plurality of holes. A cover is pivotally mounted to the barrel and has a recess defined in the inside thereof for a front sub-pushing member and a rear sub-pushing member pivotally engaged therewith. A main pushing member has a plurality of protrusions extending from two opposite sides thereof so as to engage with the holes of the nail input chamber. The rear sub-pushing member has a first stop extending from the top thereof with a spring biased between the rear sub-pushing member and the cover. The front sub-pushing member has a second stop extending from the top thereof and with another spring biased between the front sub-pushing member and the cover. A limit member is connected between the front sub-pushing member and the rear sub-pushing member so as to limit the front sub-pushing member and the rear sub-pushing member form disengaging from the recess of the cover. A plug is connected to the main pushing member by a pin and located below the nail input chamber.

The object of the present invention is to provide a nail engaging device which has two pivotable pushing members respectively located at the front section and the rear section of the nails, the rear pushing member can be pivoted away from the barrel so as to receive the plastic plate having a thicker thickness.

Further features of the present invention will become apparent after a careful reading of the detailed description with appropriate reference to the accompanying drawings.

DETAILED DESCRIPTION OF THE PREFERRED EMBODIMENTS

Figure 1:
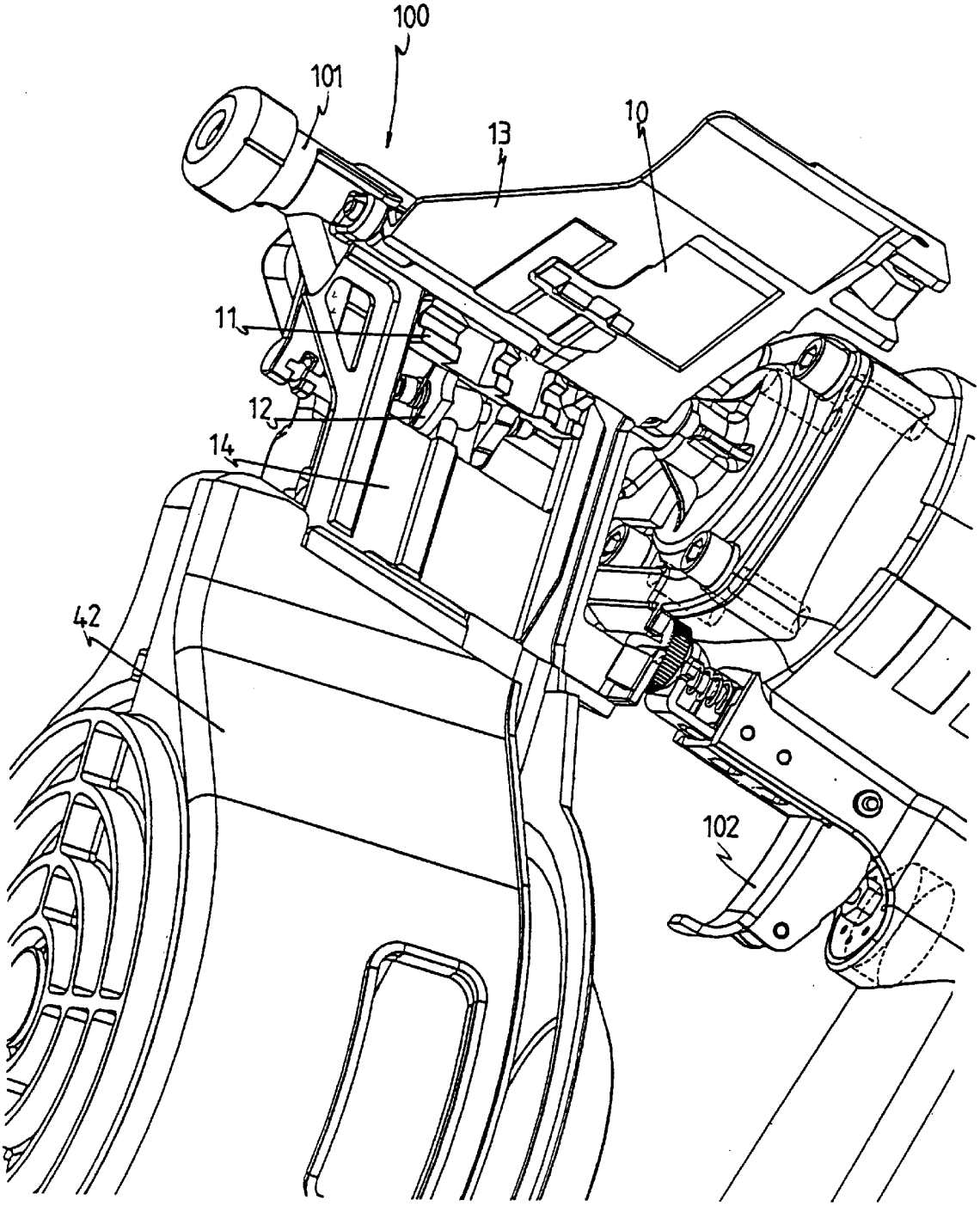
FIG. 1 PRIOR ART
FIG. 1 is a perspective view of the conventional nail engaging device of a power nailer.
Figure 2:
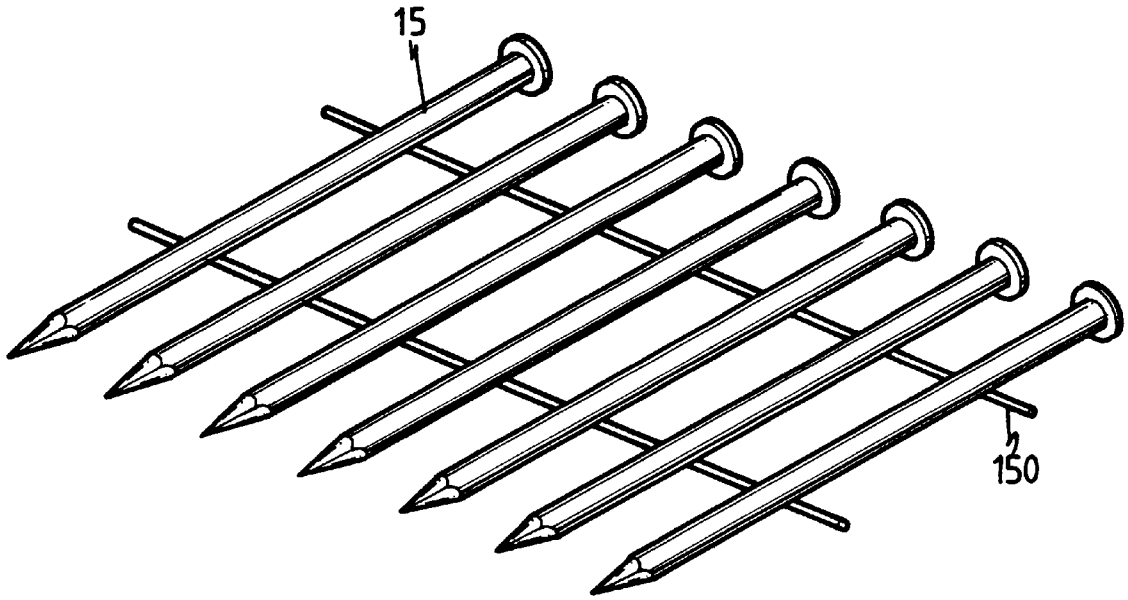
FIG. 2 PRIOR ART
FIG. 2 is a perspective view of the nails connected by two metal wires.
Figure 2A:
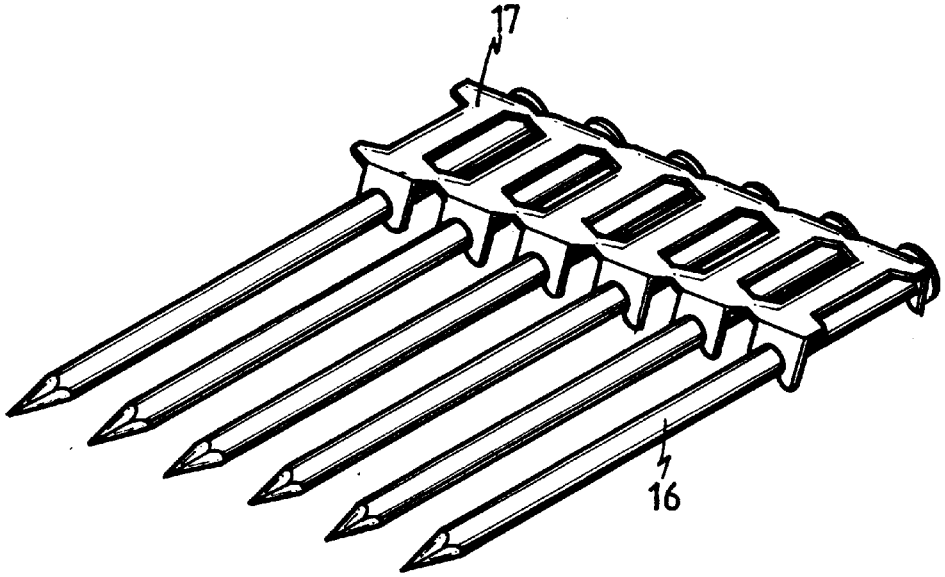
FIG. 2A PRIOR ART
FIG. 2A is a perspective view of nails connected by a plastic plate.
Figure 3:
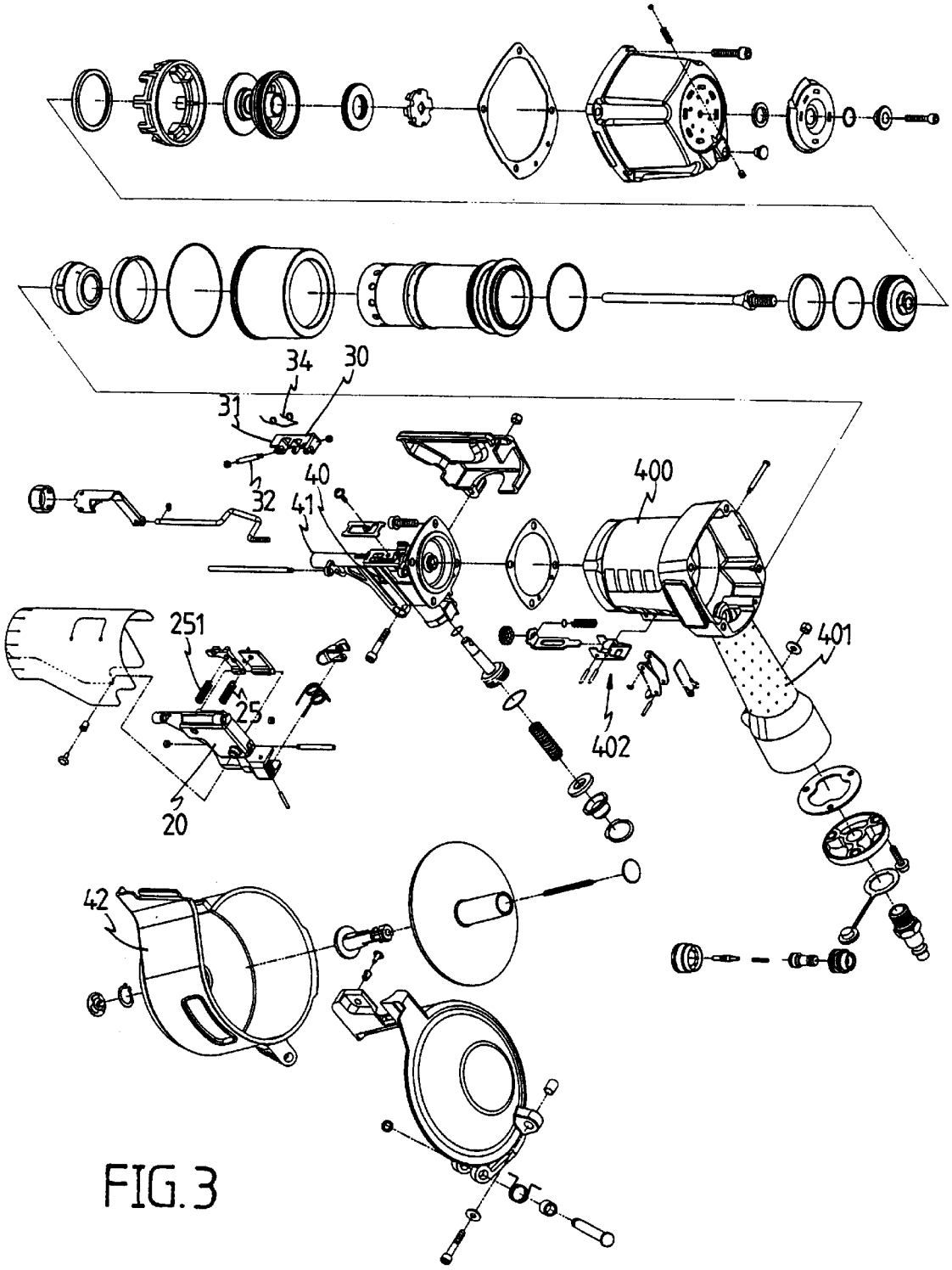
FIG. 3 is an exploded view to show the nail engaging device in accordance with the present invention.
Figure 4:
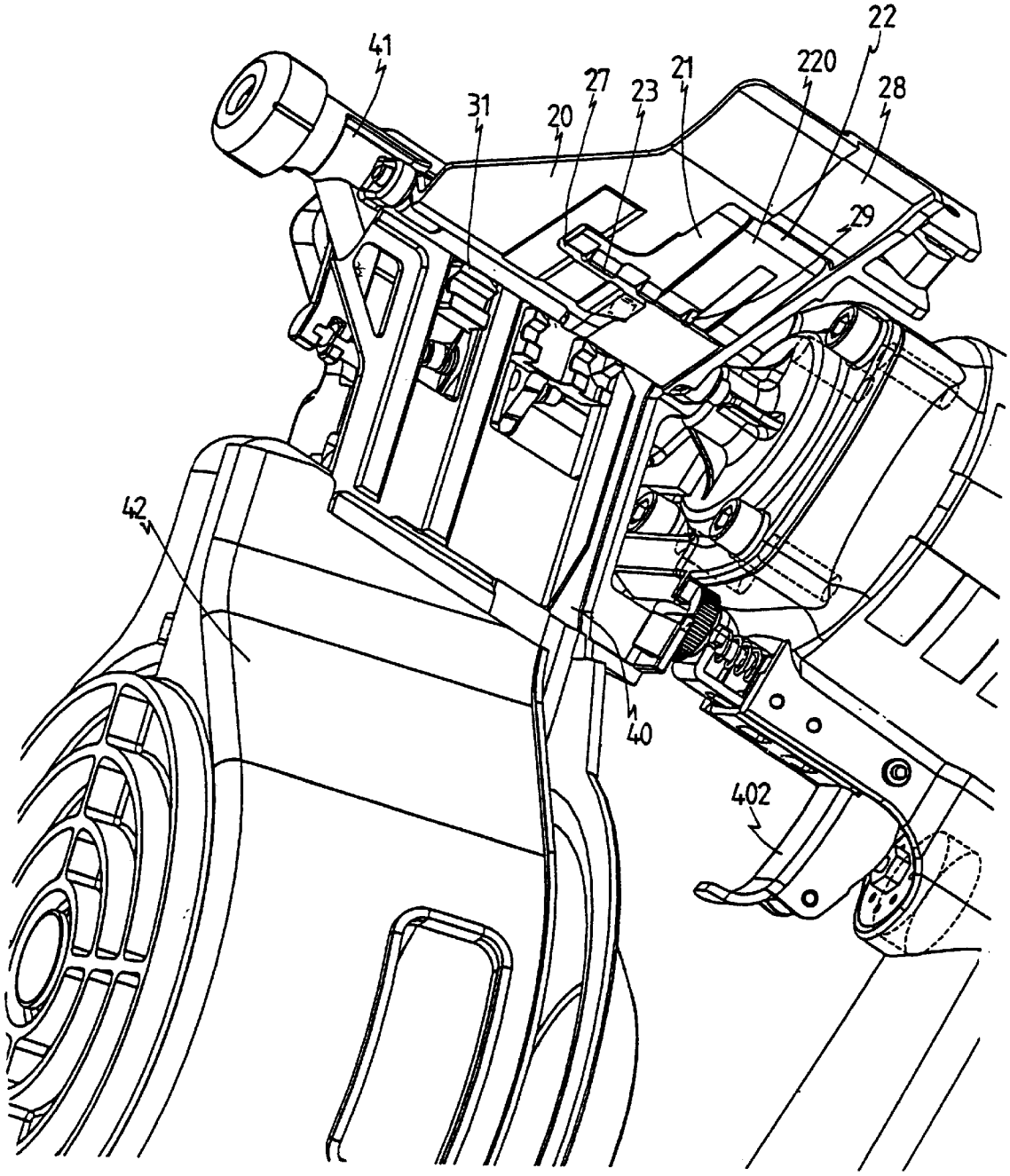
FIG. 4 is a perspective view of the nail engaging device in accordance with the present invention.
Figure 5:
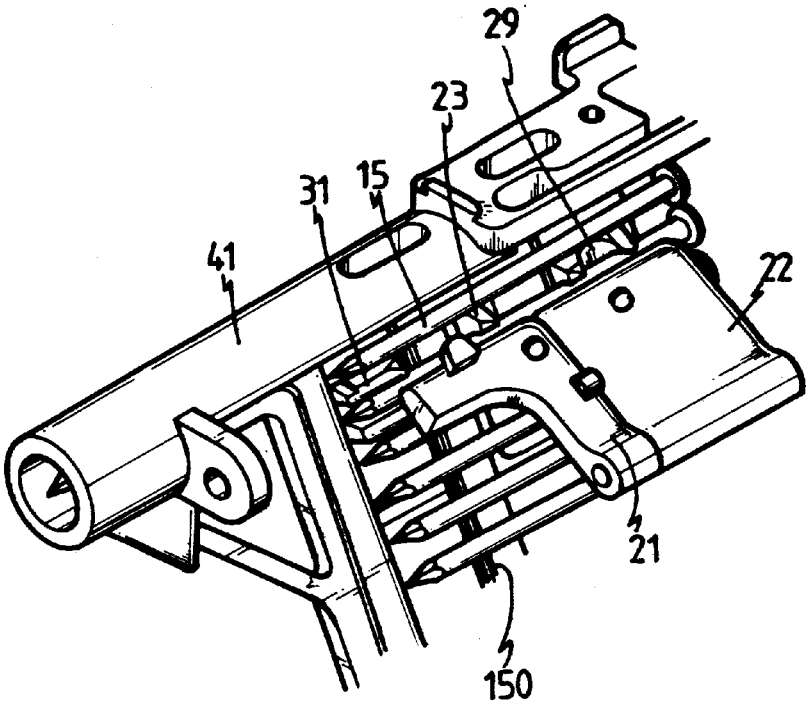
FIG. 5 is a perspective illustrative view to show the nails connected by metal wires are engaged with the nail engaging device in accordance with the present invention.

Referring to FIGS. 3 to 5, a power nailer has a barrel 41 and a body 400 from which the barrel 41 extends. A handle 401 is connected to the body 400 and connected to a pneumatic system (not shown), a trigger 402 attached to the handle 401. A nail box 42 is connected to the barrel 41 by the nail engaging device of the present invention so that nails 15 can be injected from the barrel 41 by the pneumatic force when pulling the trigger.

Figure 7:
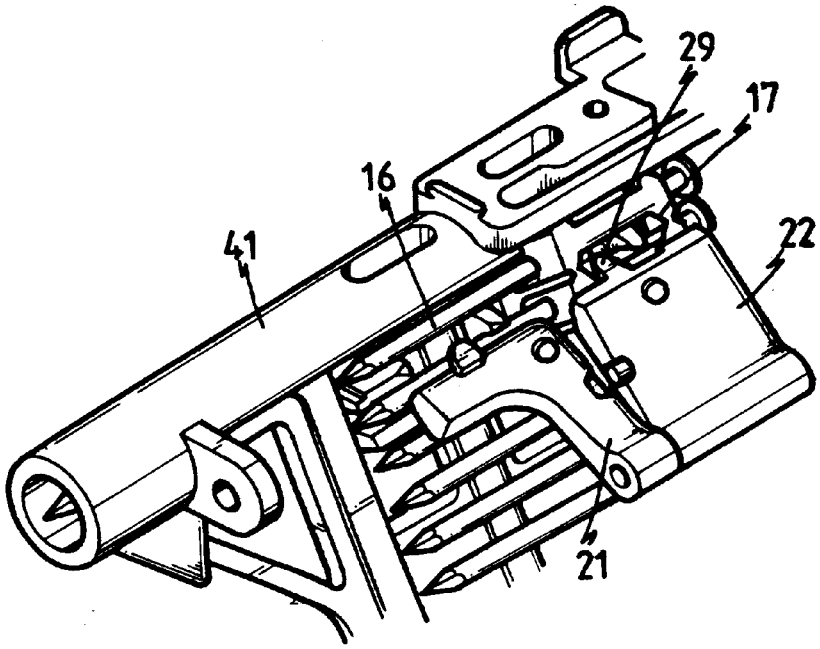
FIG. 7 is a perspective illustrative view to show the nails connected by a plastic plate are engaged with the nail engaging device in accordance with the present invention.
Figure 8:
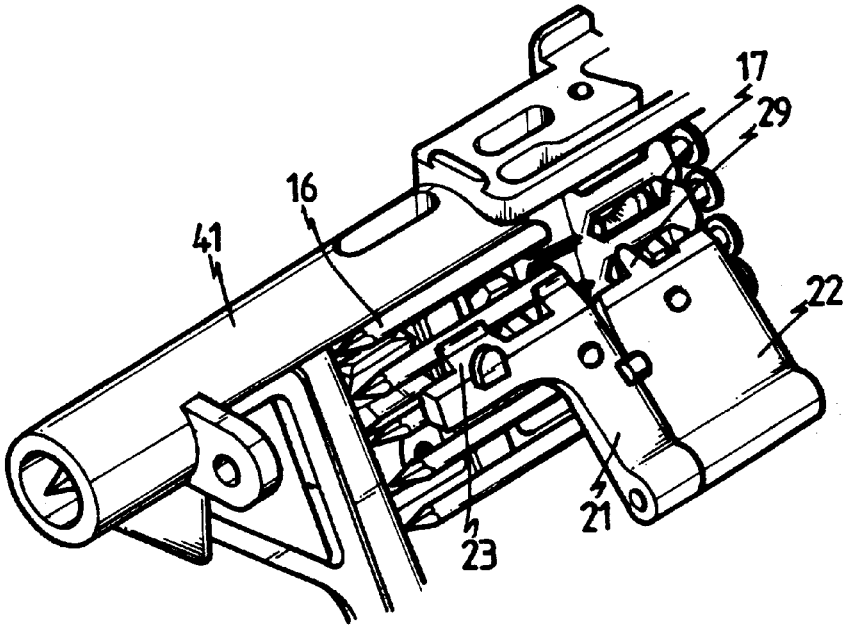
FIG. 8 is a perspective illustrative view to show the nails connected by the plastic plate are pushed into the barrel after the trigger of the power nailer is pulled.

The nail engaging device of the present invention comprises a nail input chamber 40 connected between the barrel 41 and the nail box 42, and the nail input chamber 40 having a plurality of holes. A cover 20 is pivotally mounted to the barrel 41 and has a recess 27 defined in the inside thereof. A first guide recess 28 is defined in the inside of the cover 20 so as to receive the plastic plate (17) as shown in FIG. 7 and 8. A main pushing member 30 has a plurality of protrusions 31 extending from two opposite sides thereof so as to engage with the holes of the nail input chamber 40. A plug 33 is connected to the main pushing member 30 by a pin 32 extending through the plug 33 and the main pushing member 30. The plug 33 is located below the nail input chamber 40 and has a torsion spring 34 connected thereto so that the plug 33 may return to its original position after it is pushed by the pneumatic force.

A rear sub-pushing member 22 has a first stop 29 extending from the top thereof and is pivotally engaged with the recess 27 of the cover 20. A spring 25 is biased between the rear sub-pushing member 22 and the cover 20. A front sub-pushing member 21 has a second stop 23 extending from the top thereof and is pivotally engaged with the recess 27 of the cover 20. Another spring 251 is biased between the front sub-pushing member 21 and the cover 20. A limit member 26 is connected between the front sub-pushing member 21 and the rear sub-pushing member 22 so as to limit the front sub-pushing member 21 and the rear sub-pushing member 22 form disengaging from the recess 27 of the cover 20. The rear sub-pushing member 22 has a second guide recess 220 defined in the inside thereof so as to guide the nails 15/16.

Figure 6:
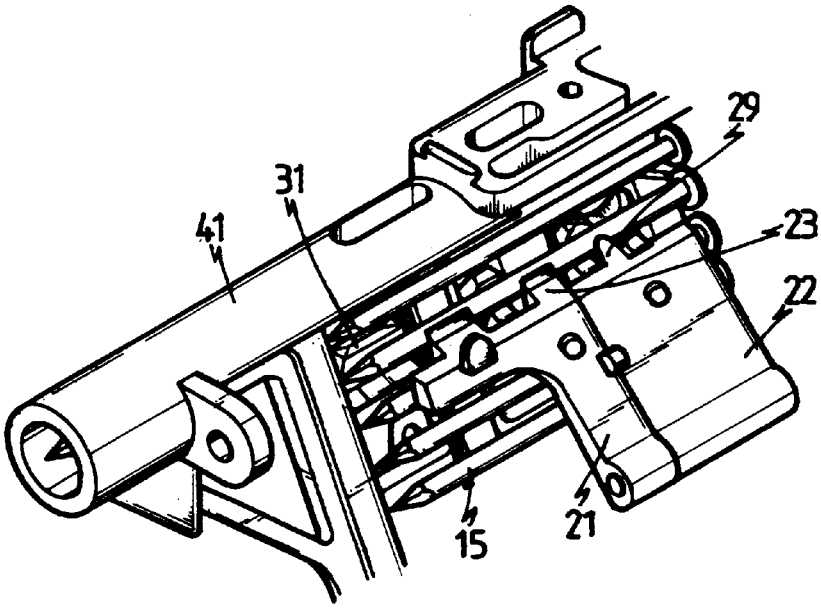
FIG. 6 is a perspective illustrative view to show the nails connected by metal wires are pushed into the barrel after the trigger of the power nailer is pulled.

When engaging the nails 15 connected by wires 150 in the nail input chamber 40, the first nail 15 is engaged between the two protrusions 31. The cover 20 is then covered onto the nails 15. The second stop 23 of the front sub-pushing member 21 is located below the front section of the first nail 15 and the first stop 29 of the rear sub-pushing member 22 is located below the rear section of the first nail 15. When the trigger 402 is pulled, as shown in FIG. 6, the plug 33 is pushed downwardly so as to move the main pushing member 30 downwardly. The first nail 15 is stopped by the first stop 29 and the second stop 23 so that the main pushing member 30 is inclined to move over the first nail 15. The main pushing member 30 will be engaged with the second nail 15 after it returns by the torsion spring 34. At this moment, the plug 33 returns and, together with the main pushing member 30, push the second nail 15 upwardly. The second nail 15 moves over the first stop 23 and the second stop 29 to raise the first nail 15 into the barrel 41 ready for an injection.

Referring to FIGS. 7 and 8, the actions of the nails 16 connected by a plastic plate 17 and engaged with the device of the present invention are the same as those described with respect to FIGS. 5 and 6. The first stop 23 of the front sub-pushing member 21 is located below the front section of the first nail 16 and the rear sub-pushing member 22 is pushed into the recess 27 of the cover 20 by the thicker plastic plate 17. The second stop 29 of the rear sub-pushing member 22 is engaged with the slot defined between the two adjacent nails 16. The plug 33 and the main pushing member 30 are moved downwardly when the trigger 402 is pulled. The first nail 16 is stopped by the first stop 29 and the second stop 23 so that the main pushing member 30 is inclined to move over the first nail 15. The main pushing member 30 will be engaged with the second nail 16 after it returns by the torsion spring 34. At this moment, the plug 33 returns and, together with the main pushing member 30, push the second nail 16 upwardly. The second nail 16 moves over the first stop 23 and the second stop 29 to raise the first nail 16 into the barrel 41 ready for an injection.

Accordingly, the device in accordance with the present invention can be cooperated with the two types of nails 15, 16 without changing any structure or replacing any parts. The rear sub-pushing member 22 is pivoted independently from the front sub-pushing member 21 so that the thicker plastic plate 17 can be used in the device of the present invention.

It is to be understood that the above description and drawings are only used for illustrating some embodiments of the present invention, not intended to limit the scope thereof. Any variation and derivation from the above description and drawings should be included in the scope of the present invention.

What is claimed is:

1. A nail engaging device for a power nailer which has a barrel and a body from which the barrel extends, a nail box connected to the barrel by said nail engaging device comprising:

a nail input chamber adapted to be connected between the barrel and the nail box, said nail input chamber having a plurality of holes;

a cover adapted to pivotally mounted to the barrel and having a recess defined in the inside thereof;

a main pushing member having a plurality of protrusions extending from two opposite sides thereof so as to engage with said holes of said nail input chamber;

a rear sub-pushing member having a first stop extending from the top thereof and pivotally engaged with said recess of said cover, a spring biased between said rear sub-pushing member and said cover;

a front sub-pushing member having a second stop extending from the top thereof and pivotally engaged with said recess of said cover, a spring biased between said front sub-pushing member and said cover, a limit member connected between said front sub-pushing member and said rear sub-pushing member so as to limit said front sub-pushing member and said rear sub-pushing member form disengaging from said recess of said cover, and a plug connected to said main pushing member by a pin and located below said nail input chamber.

2. The device as claimed in claim 1, wherein said cover has a first guide recess defined in the inside thereof.

3. The device as claimed in claim 1, wherein said rear sub-pushing member has a second guide recess defined in the inside thereof.

* * * * *